US008242995B2

(12) United States Patent
Lee

(10) Patent No.: US 8,242,995 B2
(45) Date of Patent: Aug. 14, 2012

(54) LIGHT EMITTING DISPLAY DEVICE AND METHOD FOR DRIVING THE SAME

(75) Inventor: Chang Hwan Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1106 days.

(21) Appl. No.: 11/474,976

(22) Filed: Jun. 27, 2006

(65) Prior Publication Data

US 2007/0001959 A1 Jan. 4, 2007

(30) Foreign Application Priority Data

Jun. 30, 2005 (KR) ..... 10-2005-0057573

(51) Int. Cl.
*G09G 3/36* (2006.01)

(52) U.S. Cl. ..... 345/92; 345/76; 345/82; 315/169.1

(58) Field of Classification Search ..... 345/76–83; 315/160–176
See application file for complete search history.

(56) References Cited

U.S. PATENT DOCUMENTS 5,739,682 A * 4/1998 Kay ..... 323/315
7,123,237 B2 * 10/2006 Sato et al. ..... 345/98
7,319,443 B2 * 1/2008 Kimura et al. ..... 345/76
2002/0021293 A1 * 2/2002 Tam ..... 345/204
2004/0004443 A1 1/2004 Park et al.
2005/0264492 A1 * 12/2005 Knapp et al. ..... 345/76

FOREIGN PATENT DOCUMENTS

WO WO 2004023446 A1 * 3/2004

* cited by examiner

*Primary Examiner* — Joe H Cheng
(74) *Attorney, Agent, or Firm* — McKenna Long & Aldridge LLP

(57) ABSTRACT

A light emitting display device and a method for driving the same are disclosed. Each pixel of the light emitting display device includes: a light emitting element that emits light in response to a drive current based on a gray-scale current on the associated data line; a first switching element that supplies the drive current to the light emitting element; a first voltage line that supplies a first voltage to a source electrode of the first switching element; a second switching element connected with the first switching element that forms a current mirror with the first switching element; a second voltage line that supplies a second voltage of the second switching element; and a voltage supply circuit that divides the first voltage from the first voltage line and the second voltage from the second voltage line and supplies the resulting voltage to a source electrode of the second switching element.

4 Claims, 5 Drawing Sheets

LIGHT EMITTING DISPLAY DEVICE AND METHOD FOR DRIVING THE SAME

This application claims the benefit of Korean Patent Application No. 10-2005-0057573, filed on Jun. 30, 2005, which is hereby incorporated by reference for all purposes as if fully set forth herein.

BACKGROUND OF THE INVENTION

1. Field of the Invention

The present invention relates to a light emitting display device, and more particularly, to a light emitting display device that is capable of avoiding a brightness difference between respective pixels resulting from a voltage variation, and a method for driving the same.

2. Discussion of the Related Art

Recently, various flat panel display devices have been developed to reduce weight and volume which are disadvantages of a cathode ray tube. These flat panel display devices may be, for example, a liquid crystal display, a field emission display, a plasma display panel, a light emitting display, and the like.

The light emitting display, among the flat panel display devices, is of a spontaneous emission type wherein fluorescent material is excited due to recombination of electrons and holes to emit light. Such light emitting displays are roughly classified into an inorganic light emitting display device that employs an inorganic compound as fluorescent material and an organic light emitting display device that employs an organic compound as fluorescent material. These light emitting displays are expected to replace the cathode ray tube displays owing to their many advantages, such as, low-voltage driving, self-luminescence, thinness, wide viewing angle, high response speed, high contrast, etc.

An organic light emitting element generally has an electron injection layer, electron transport layer, light emitting layer, hole transport layer and hole injection layer interposed between a cathode and an anode. In a light emitting display device using this organic light emitting element, when a certain voltage is applied between the anode and the cathode, electrons generated from the cathode move to the light emitting layer through the electron injection layer and electron transport layer, and holes generated from the anode are moved to the light emitting layer through the hole injection layer and hole transport layer. As a result, in the light emitting layer, the electrons from the electron transport layer and the holes from the hole transport layer are recombined, thus emitting light.

A pixel of the light emitting display device generally has a light emitting element for emitting light in response to a drive current applied thereto, and a pixel circuit for operating the light emitting element. The pixel circuit includes first and second thin film transistors (TFTs) interconnected in the form of a current mirror. The first and second TFTs are supplied with a voltage from a single voltage source.

The first TFT conducts drive current corresponding to gray-scale current applied to a data line and supplies it to the light emitting element. In the light emitting display device, conventionally, gray-scale current larger than that corresponding to an image to be currently expressed is applied to the data line for the purpose of increasing the charging speed of the data line. This operation can be carried out on the premise that the mirror ratio between the first TFT and the second TFT must be set to a large value. That is, the channel width of the first TFT must be set to a smaller value and the channel width of the second TFT must be set to a larger value.

This enables drive current flowing through the first TFT to have the value of gray-scale current corresponding to an image to be currently expressed.

When this mirror ratio is larger, larger gray-scale current can be applied to the data line. However, the mirror ratio is greatly restricted by a TFT design constraints. For this reason, it is not possible to unconditionally make the mirror ratio large. As a result, increasing the charging speed of the data line is still hampered by a big restriction.

In order to solve this problem, a technique has been proposed that is capable of applying different voltages respectively to the first TFT and second TFT to increase the difference between current flowing through the first TFT and current flowing through the second TFT without making the mirror ratio large.

A detailed description will hereinafter be given of a conventional light emitting display device based on the above technique.

FIG. 1 is a circuit diagram showing the structure of two pixels in the conventional light emitting display device.

The conventional light emitting display device comprises a display unit (not shown) that has a plurality of pixels defined by a plurality of gate lines GL and a plurality of data lines DL crossing each other substantially perpendicularly, as shown in FIG. 1.

Each pixel includes a first voltage line VL1 for supplying a first voltage VDD1, a second voltage line VL2 for supplying a second voltage VDD2, a pixel circuit 11 connected to the associated data line DL and gate line GL, and a light emitting element OLED connected between the pixel circuit 11 and a third voltage line VL3 that supplies a third voltage GND.

The pixel circuit 11 of each pixel includes first and second TFTs Tr11 and Tr12 interconnected via a node n for forming a current mirror, a capacitor Cst connected between the gate electrode and source electrode of the first TFT Tr11, a third TFT Tr13 for operating the second TFT Tr12 in a diode manner in response to a scan pulse from the gate line GL, and a fourth TFT Tr14 for forming a current path between the second voltage line VL2 and the data line DL in response to the scan pulse from the gate line GL. The first voltage line VL1 is connected to the first TFT Tr11 to supply the first voltage VDD1 to the first TFT Tr11. The second voltage line VL2 is connected to the second TFT Tr12 to supply the second voltage VDD2 to the second TFT Tr12.

Here, by setting the second voltage VDD2 to a higher value than the first voltage VDD1, it is possible to set gray-scale current flowing through the second TFT Tr12 to a larger value than drive current flowing through the first TFT Tr11 without increasing a mirror ratio between the first TFT Tr11 and the second TFT Tr12. The gray-scale current is sunk to a data driver (not shown) through a current path consisting of the second voltage line VL2, second TFT Tr12, fourth TFT Tr14 and data line DL.

However, the light emitting display device with this structure has the advantage of increasing the difference between the amount of current flowing through the first TFT Tr11 and the amount of current flowing through the second TFT Tr12 without increasing the mirror ratio, as mentioned above, but has the following problem because the first voltage line VL1 and the second voltage line VL2, independent of each other, are used.

That is, the first voltage line VL1 and the second voltage line VL2 are arranged in parallel with the data line DL. Each pixel arranged along the data line DL is connected in parallel to the first and second voltage lines VL1 and VL2, so as to receive the first voltage VDD1 and the second voltage VDD2 in common. Notably, as the light emitting display device becomes larger in size, the first and second voltage lines VL1 and VL2 are thus increased in length, thereby causing the first and second voltage lines VL1 and VL2 to have a larger amount of resistance and capacitance components. This becomes more serious toward the ends of the first and second voltage lines VL1 and VL2. As a result, brightness nonuniformity appears between the pixels connected in common to the first and second voltage lines VL1 and VL2. The reason is that the levels of the first and second voltages VDD1 and VDD2 from the first and second voltage lines VL1 and VL2 become lower toward the ends of the corresponding lines due to the resistance and capacitance components of those lines.

In particular, the distortion of the first voltage VDD1 from the first voltage line VL1 becomes a big issue, because the first voltage VDD1 is related to drive current to be supplied to the light emitting element OLED. In addition, because the first voltage VDD1 from the first voltage line VL1 is lower than the second voltage VDD2, it is more easily influenced by the resistance and capacitance components. In contrast, the second voltage VDD2 from the second voltage line VL2 is influenced less by the resistance and capacitance components, so that the pixels receive the second voltage VDD2 of substantially the same level. When the first voltage VDD1 varies like this, the voltage at the source electrode of the first TFT Tr11 varies. At this time, because the voltage at the gate electrode of the first TFT Tr11 is fixed in level, the voltage between the gate electrode and source electrode of the first TFT Tr11 varies in the end. As a result, the value of the drive current flowing through the first TFT Tr11 varies, thereby causing the light emitting element OLED of each pixel to exhibit different brightness with respect to the same gray-scale current. In conclusion, the picture quality of the light emitting display device is degraded.

SUMMARY OF THE INVENTION

Accordingly, the present invention is directed to a light emitting display device and a method for driving the same that substantially obviate one or more problems due to limitations and disadvantages of the related art.

An advantage of the present invention is to provide a light emitting display device that is capable of supplying a first voltage to a first TFT and a voltage resulting from division of the first voltage and a second voltage to a second TFT, respectively, such that the voltage to the second TFT varies with the first voltage, thereby minimizing a variation in the voltage between the gate electrode and source electrode of the first TFT, and a method for driving the same.

Additional features and advantages of the invention will be set forth in the description which follows, and in part will be apparent from the description, or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described, a light emitting display device may include a display unit having a plurality of pixels defined by a plurality of gate lines and a plurality of data lines, each of the pixels including: a light emitting element that emits light in response to a drive current based on a gray-scale current on the associated data line; a first switching element that supplies the drive current to the light emitting element; a second switching element connected with the first switching element that forms a current mirror with the first switching element; a first voltage line that supplies a first voltage to the first switching element; a second voltage line that supplies a second voltage to the second switching element; and a voltage supply circuit that divides the first voltage from the first voltage line and the second voltage from the second voltage line and supplies the resulting voltage to a source electrode of the second switching element.

In another aspect of the present invention, a method for driving a light emitting display device, where the light emitting display device includes a display unit having a plurality of pixels defined by a plurality of gate lines and a plurality of data lines, each of the pixels including a light emitting element that emits light in response to drive current based on a gray-scale current on an associated one of the data lines, a first switching element that supplies the drive current to the light emitting element, a second switching element connected with the first switching element that forms a current mirror with the first switching element, a first voltage line that supplies a first voltage to the first switching element, and a second voltage line that supplies a second voltage to the second switching element, a third switching element for forming a short circuit between a gate electrode and drain electrode of the second switching element in response to a scan pulse from an associated one of the gate lines, a fourth switching element for connecting the second switching element with the associated data line in response to the scan pulse from the associated gate line, includes: dividing the first voltage from the first voltage line and the second voltage from the second voltage line; and supplying the divided voltage to a source electrode of the second switching element.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
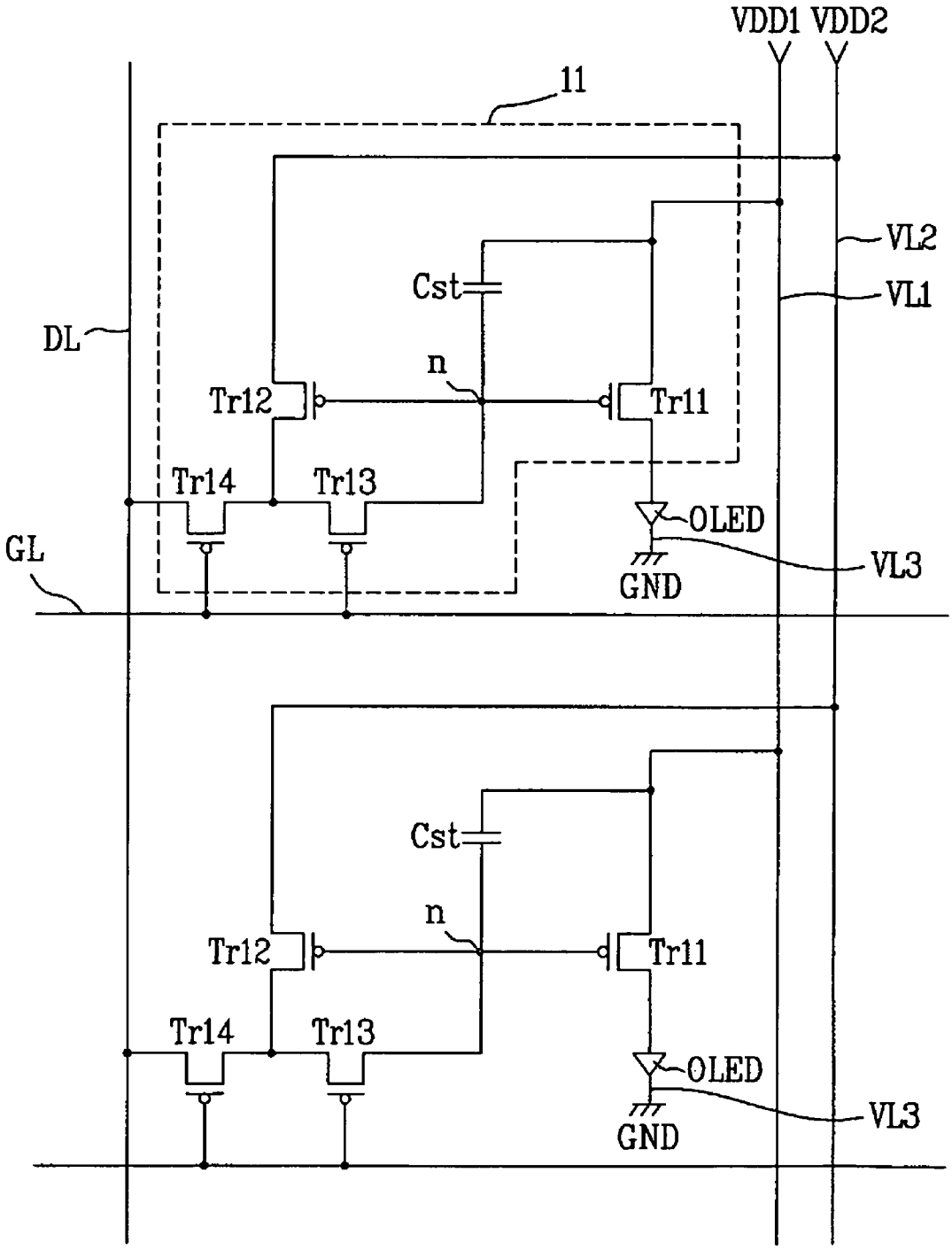
FIG. 1 Related Art
FIG. 1 is a circuit diagram showing the structure of two pixels in a conventional light emitting display device.
Figure 2:
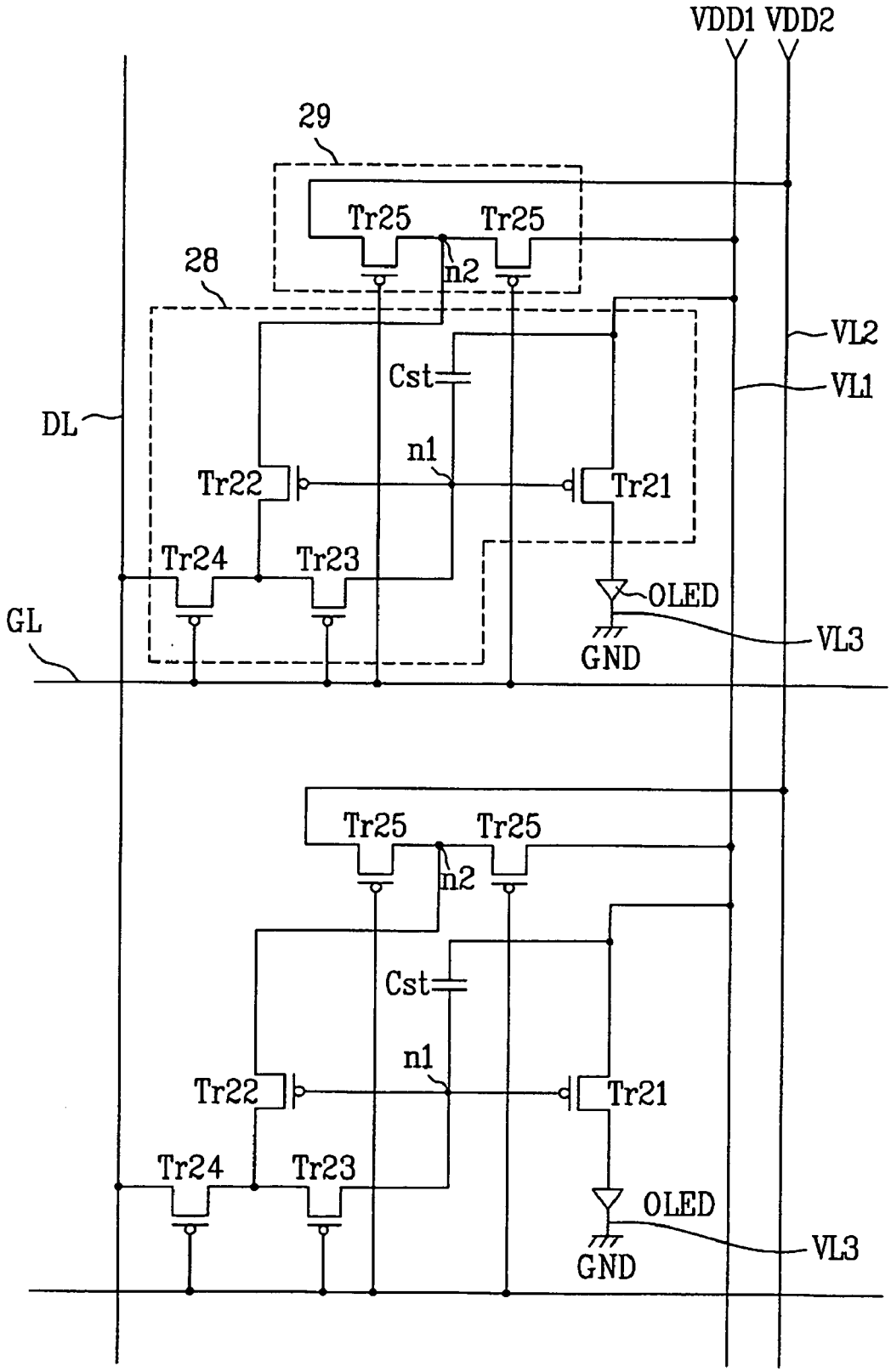
FIG. 2 is a circuit diagram showing the structure of two pixels in a light emitting display device according to a first embodiment of the present invention.

FIG. 2 shows the structure of two pixels in a light emitting display device according to a first embodiment of the present invention.

The light emitting display device according to the first embodiment of the present invention includes a display unit (not shown) that has a plurality of pixels defined by a plurality of gate lines GL and a plurality of data lines DL crossing each other substantially perpendicularly, as shown in FIG. 2.

Each pixel includes a first voltage line VL1 for supplying a first voltage VDD1, a second voltage line VL2 for supplying a second voltage VDD2, a pixel circuit 28 connected to the associated data line DL and gate line GL, a light emitting element OLED connected between the pixel circuit 28 and a third voltage line VL3 which supplies a third voltage GND, and a voltage supply circuit 29 for dividing the first voltage VDD1 from the first voltage line VL1 and the second voltage VDD2 from the second voltage line VL2 and supplying the resulting voltage to the pixel circuit 28. The light emitting display device according to the first embodiment of the present invention further includes a gate driver (not shown) for driving the gate lines GL and a data driver (not shown) for supplying gray-scale current over the data lines DL.

The pixel circuit 28 of each pixel includes first to fourth TFTs Tr21 to Tr24, and a capacitor Cst. A detailed description will hereinafter be given of the respective constituent elements of the pixel circuit 28.

The first TFT Tr21 has a gate electrode connected to a first node n1, a source electrode connected to the first voltage line VL1, and a drain electrode connected to the light emitting element OLED. The first TFT Tr21 conducts drive current through the source and drain electrodes thereof to turn on the light emitting element OLED.

The second TFT Tr22 is connected with the first TFT Tr21 to form a current mirror with the first TFT Tr21. That is, the first TFT Tr21 and the second TFT Tr22 are interconnected to form the current mirror. In detail, the second TFT Tr22 has a gate electrode connected to the gate electrode of the first TFT Tr21 via the first node n1, and a source electrode connected to the voltage supply circuit 29. Because the first TFT Tr21 and the second TFT Tr22 form the current mirror in this manner, the amount of drive current flowing through the first TFT Tr21 is equal to that of gray-scale current flowing through the second TFT Tr22 on the assumption that the first TFT Tr21 and the second TFT Tr22 have the same characteristics. In general, the mirror ratio between the first TFT Tr21 and the second TFT Tr22 can be adjusted by making the channel width or channel length of the first TFT Tr21 and the channel width or channel length of the second TFT Tr22 different.

The third TFT Tr23 has a gate electrode connected to the associated gate line GL, a source electrode connected to the first node n1, and a drain electrode connected to the drain electrode of the second TFT Tr22. That is, the third TFT Tr23 forms a short circuit between the gate electrode and drain electrode of the second TFT Tr22 in response to a scan pulse from the gate line GL. By doing so, the third TFT Tr23 operates the second TFT Tr22 in a diode manner.

The fourth TFT Tr24 has a gate electrode connected to the associated gate line GL, a source electrode connected to the drain electrode of the second TFT Tr22, and a drain electrode connected to the associated data line DL. That is, the fourth TFT Tr24 connects the voltage supply circuit 29 with the data line DL in response to the scan pulse from the gate line GL. In other words, the fourth TFT Tr24 forms a current path between the voltage supply circuit 29 and the data line DL. Gray-scale current flowing through the second TFT Tr22 is sunk to the data driver through the current path and the data line DL. As the gray-scale current is sunk to the data driver, a voltage based on the gray-scale current appears at the first node n1, and the first TFT Tr21 is driven by the difference between the voltage at the node n1 and the first voltage VDD1 supplied to the source electrode of the first TFT Tr21. At this time, the first TFT Tr21 conducts drive current corresponding to the voltage difference and supplies it to the light emitting element OLED, so as to turn on the light emitting element OLED.

The capacitor Cst is connected between the gate electrode (first node n1) and source electrode of the first TFT Tr21. This capacitor Cst stores the difference between the voltage at the first node n1 and the first voltage VDD1 to sustain the first TFT Tr21 at its turn-on state for one frame.

The first voltage line VL1 is arranged in parallel with the data line DL. This first voltage line VL1 supplies the first voltage VDD1. Each pixel arranged along the first voltage line VL1 is connected in parallel to the first voltage line VL1 to receive the first voltage VDD1 from the first voltage line VL1. At this time, currents applied to the respective VL1 depend on data values represented in the respective sub-pixels. In other words, if data values represented in the respective sub-pixels are different with one another, currents applied to the respective VL1 are different with one another and if not, currents are same with one another.

The second voltage line VL2 is also arranged in parallel with the data line DL. This second voltage line VL2 supplies the second voltage VDD2. Each pixel arranged along the second voltage line VL2 is connected in parallel to the second voltage line VL2 to receive the second voltage VDD2 from the second voltage line VL2.

The voltage supply circuit 29 includes at least two fifth TFTs Tr25, which are connected in series between the first voltage line VL1 and the second voltage line VL2. The fifth TFTs Tr25 have their respective gate electrodes connected in common to the gate line GL. The fifth TFTs Tr25 have certain resistances when they are turned on. As a result, the first voltage VDD1 from the first voltage line VL1 and the second voltage VDD2 from the second voltage line VL2 are divided through the fifth TFTs Tr25 and the resulting voltage is applied to the source electrode of the second TFT Tr22. To this end, a second node n2 positioned between the fifth TFTs Tr25 is connected to the source electrode of the second TFT Tr22.

It should be noted here that the voltage at the second node n2 is influenced by variations in the first voltage VDD1 and second voltage VDD2. In particular, the second voltage VDD2 shows little variation, but the first voltage VDD1 is subject to a severe variation because the first voltage line VL1 supplying the first voltage VDD1 is connected to the light emitting element OLED. As a result, when the first voltage VDD1 varies due to resistance and capacitance components of the first voltage line VL1, the voltage at the second node n2 varies, too. At the time that the voltage at the second node n2 varies, the voltage of the source electrode of the second TFT Tr22 also varies. At the time that the voltage of the source electrode of the second TFT Tr22 varies, the voltage of the gate electrode of the second TFT Tr22 varies, too. That is, because the gray-scale current flowing through the second TFT Tr22 is fixed in amount, the voltage of the gate electrode of the second TFT Tr22 also varies as the voltage of the source electrode of the second TFT Tr22 varies. Because the first node n1 connected to the gate electrode of the second TFT Tr22 is also connected to the gate electrode of the first TFT Tr21, the variation in the voltage at the first node n1 means the variation in the voltage of the gate electrode of the first TFT Tr21. In conclusion, when the first voltage VDD1 varies, the voltage of the gate electrode of the first TFT Tr21 also varies correspondingly thereto. In other words, when the voltage of the source electrode of the first TFT Tr21 varies with the variation in the first voltage VDD1, the voltage of the gate electrode of the first TFT Tr21 also varies correspondingly thereto.

Accordingly, even though the first voltage VDD1 varies, it is possible to minimize a variation in the voltage between the gate electrode and source electrode of the first TFT Tr21. The reason is that, when the voltage of the source electrode of the first TFT Tr21 varies with the variation in the first voltage VDD1, the voltage of the gate electrode of the first TFT Tr21 also varies correspondingly thereto, as stated above.

Meanwhile, the second voltage VDD2 is higher than the first voltage VDD1. In this regard, the voltage resulting from the division, namely, the voltage at the second node n2 is higher than the first voltage VDD1.

The operation of the light emitting display device with the above-stated configuration according to the first embodiment of the present invention will hereinafter be described in detail.

First, when a scan pulse of low logic is supplied to the associated gate line GL in a current programming period, all the third, fourth and fifth TFTs Tr23, Tr24 and Tr25 connected in common to the gate line GL are turned on. The current programming period means a period when Tr23, Tr24 and Tr25 are turnedon by scan pluse to provide the currents corresponding to the respective image data from the data driver to the respective sub-pixel.

At this time, the turned-on fifth TFTs Tr25 function as resistors with certain resistances. Thus, the voltage supply circuit 29 divides the first voltage VDD1 supplied from the first voltage line VL1 and the second voltage VDD2 supplied from the second voltage line VL2 in a predetermined ratio using the fifth TFTs Tr25, and supplies the resulting voltage to the source electrode of the second TFT Tr22 through the second node n2. On the other hand, the first voltage VDD1 from the first voltage line VL1 is supplied to the source electrode of the first TFT Tr21. In other words, the first voltage VDD1 is directly supplied to the first TFT Tr21, and the divided voltage of the first voltage VDD1 and second voltage VDD2 is supplied to the second TFT Tr22.

In a period in which the third, fourth and fifth TFTs Tr23, Tr24 and Tr25 are turned on, the data driver sinks gray-scale current corresponding to an image to be currently displayed at the associated pixel from the pixel circuit 28 over the associated data line DL. This gray-scale current is sunk to the data driver through a current path consisting of the second node n2, second TFT Tr22, fourth TFT Tr24 and data line DL. As this gray-scale current is sunk, a voltage based on the gray-scale current is applied to the first node n1. On the other hand, the gate electrode and drain electrode of the second TFT Tr22 are shorted by the turned-on third TFT Tr23. As a result, the second TFT Tr22 is operated in a saturation region. Meanwhile, the capacitor Cst stores the difference between the voltage applied to the first node n1 and the first voltage VDD1.

The first TFT Tr21 conducts drive current based on the voltage difference and supplies it to the light emitting element OLED. This drive current is almost constant in amount even though the first voltage VDD1 varies in level. The reason is that, when the first voltage VDD1 varies in level, the voltage of the gate electrode of the first TFT Tr21 also varies in level, as stated above.

Next, a detailed description will be given of a light emitting display device according to a second embodiment of the present invention.

Figure 3:
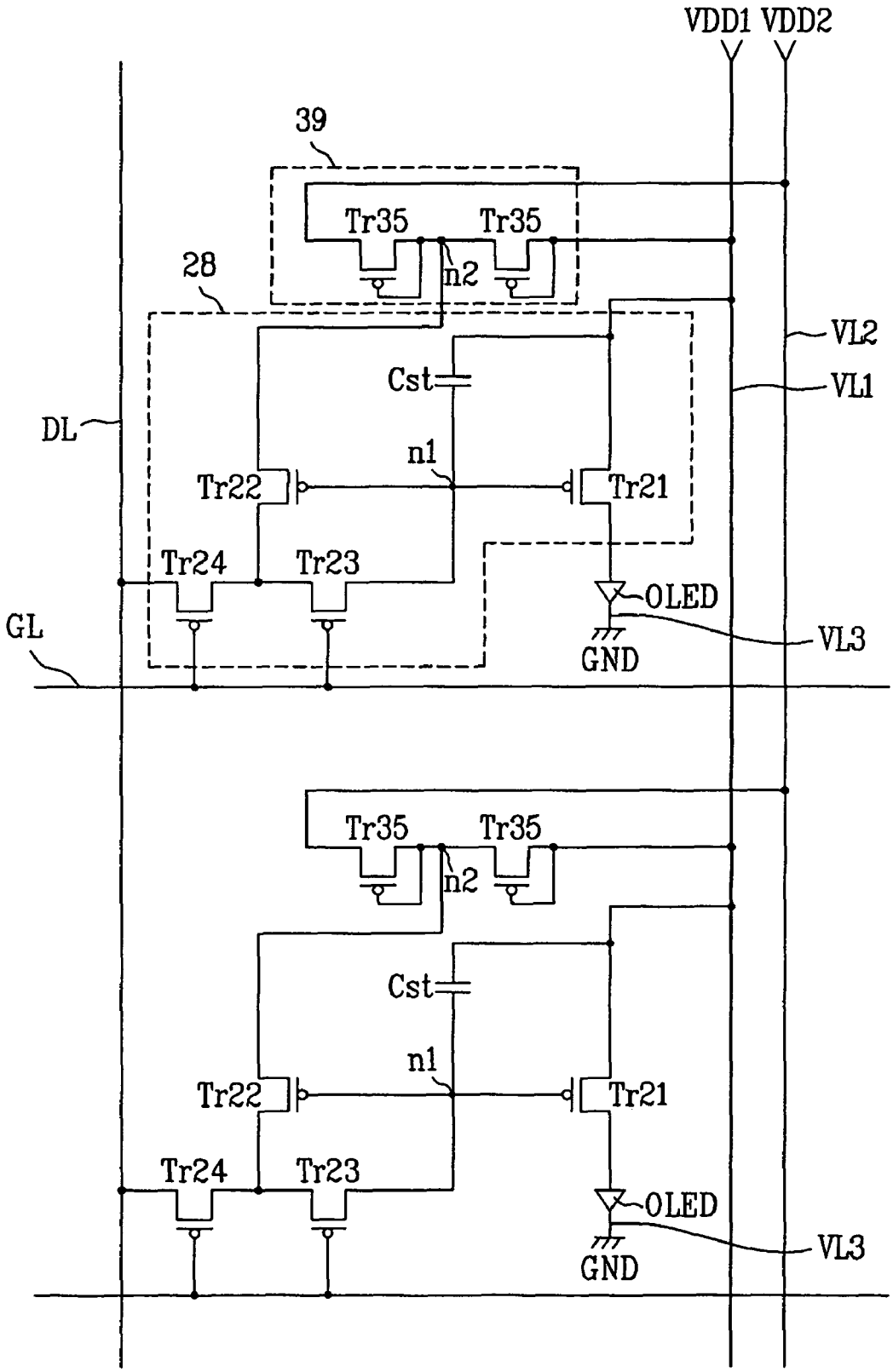
FIG. 3 is a circuit diagram showing the structure of two pixels in a light emitting display device according to a second embodiment of the present invention.

FIG. 3 shows the structure of two pixels in the light emitting display device according to the second embodiment of the present invention.

The light emitting display device according to the second embodiment is substantially the same in configuration as the above-described light emitting display device according to the first embodiment, with the exception that a voltage supply circuit 39 is different from the voltage supply circuit 29, as shown in FIG. 3.

The voltage supply circuit 39 of the light emitting display device according to the second embodiment of the present invention includes a plurality of fifth TFTs Tr35, as shown in FIG. 3. The fifth TFTs Tr35 are connected in series between the first voltage line VL1 and the second voltage line VL2. Each of the fifth TFTs Tr35 has a diode structure where the gate electrode and drain electrode thereof are shorted. In this regard, the fifth TFTs Tr35 function as resistors. As a result, the voltage supply circuit 39 divides the first voltage VDD1 and second voltage VDD2 through the fifth TFTs Tr35 and supplies the resulting voltage to the source electrode of the second TFT Tr22 through the second node n2.

Thus, in the light emitting display device according to the second embodiment of the present invention, even though the first voltage VDD1 varies, it is possible to minimize a variation in the voltage between the gate electrode and source electrode of the first TFT Tr21.

Next, a detailed description will be given of a light emitting display device according to a third embodiment of the present invention.

Figure 4:
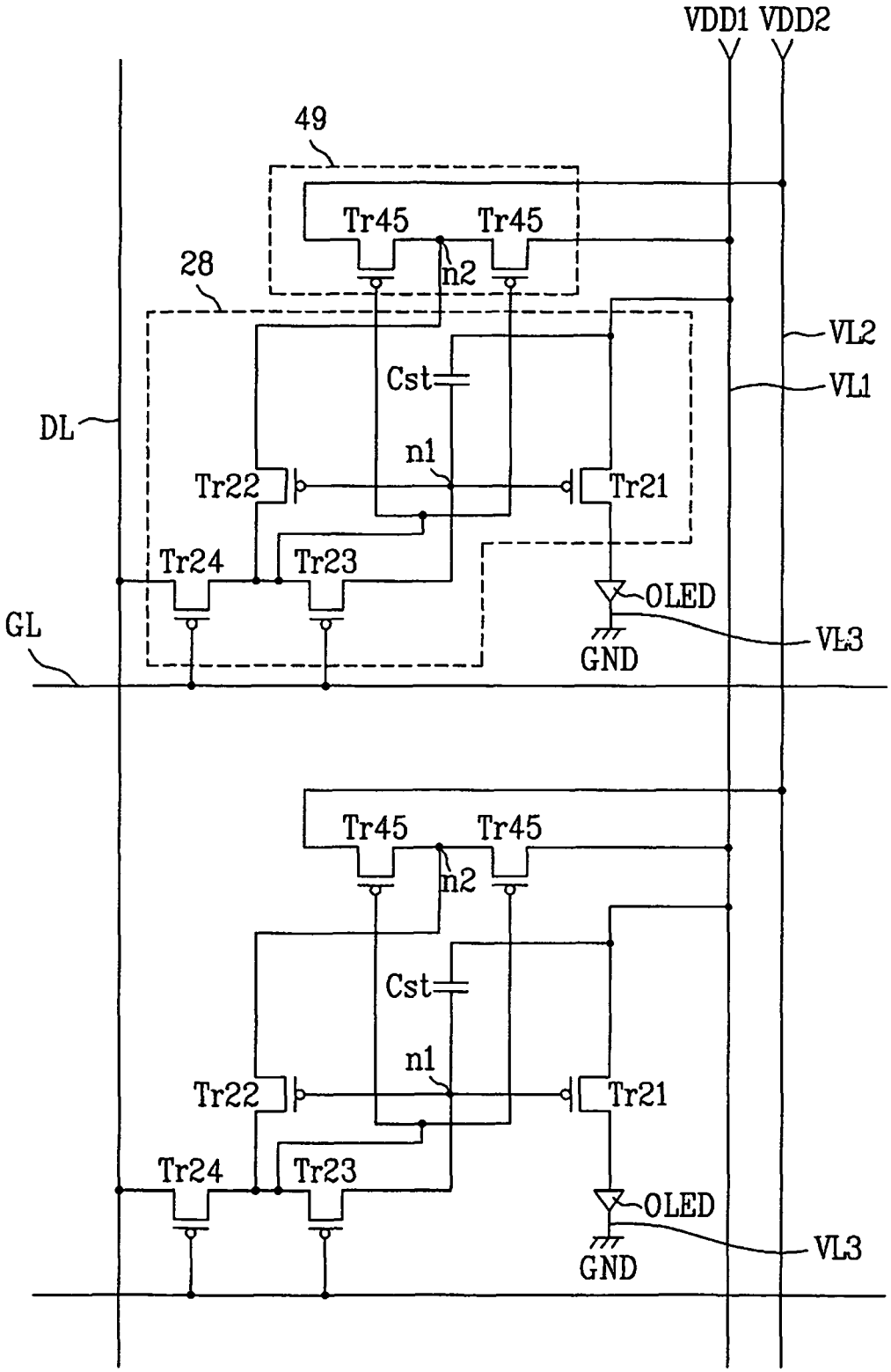
FIG. 4 is a circuit diagram showing the structure of two pixels in a light emitting display device according to a third embodiment of the present invention.

FIG. 4 shows the structure of two pixels in the light emitting display device according to the third embodiment of the present invention.

The light emitting display device according to the third embodiment is substantially the same in configuration as the above-described light emitting display device according to the first embodiment, with the exception that a voltage supply circuit 49 is different from the voltage supply circuit 29, as shown in FIG. 4.

The voltage supply circuit 49 of the light emitting display device according to the third embodiment of the present invention includes a plurality of fifth TFTs Tr45, as shown in FIG. 4. The fifth TFTs Tr45 are connected in series between the first voltage line VL1 and the second voltage line VL2. The fifth TFTs Tr45 have their respective gate electrodes connected in common to the source electrode of the fourth TFT Tr24. As a result, the fifth TFTs Tr45 are turned on by a voltage (a voltage based on gray-scale current) on the source electrode of the fourth TFT Tr24. The fifth TFTs Tr45 have certain resistances when they are turned on. Hence, the first voltage VDD1 from the first voltage line VL1 and the second voltage VDD2 from the second voltage line VL2 are divided through the fifth TFTs Tr45 and the resulting voltage is applied to the source electrode of the second TFT Tr22. To this end, the second node n2 positioned between the fifth TFTs Tr45 is connected to the source electrode of the second TFT Tr22.

Thus, in the light emitting display device according to the third embodiment of the present invention, it is possible to minimize a variation in the voltage between the gate electrode and source electrode of the first TFT Tr21 even though the first voltage VDD1 varies.

Next, a detailed description will be given of a light emitting display device according to a fourth embodiment of the present invention.

Figure 5:
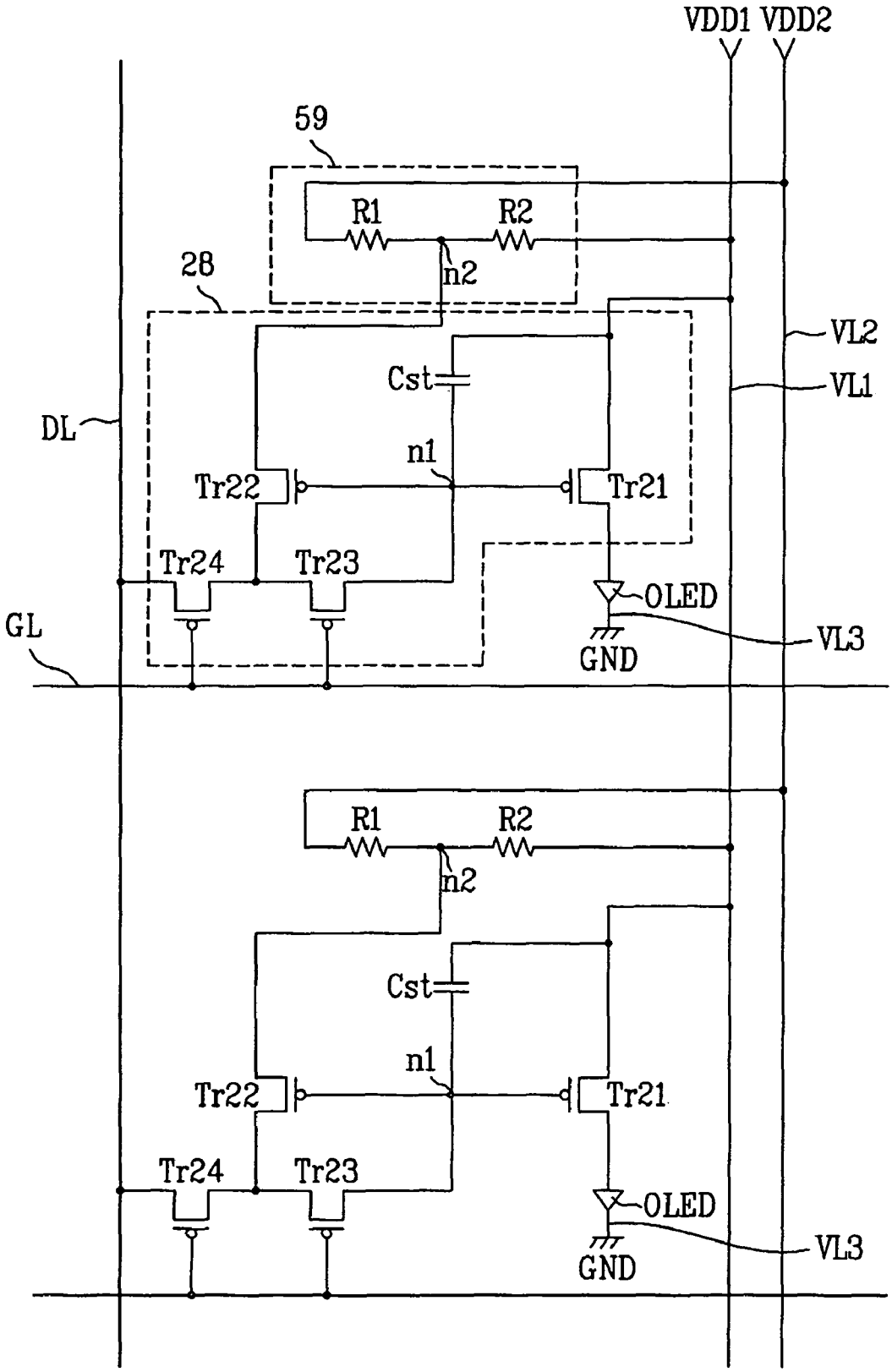
FIG. 5 is a circuit diagram showing the structure of two pixels in a light emitting display device according to a fourth embodiment of the present invention.

FIG. 5 shows the structure of two pixels in the light emitting display device according to the fourth embodiment of the present invention.

The light emitting display device according to the fourth embodiment is substantially the same in configuration as the above-described light emitting display device according to the first embodiment, with the exception that a voltage supply circuit 59 is different from the voltage supply circuit 29, as shown in FIG. 5.

The voltage supply circuit 59 of the light emitting display device according to the fourth embodiment of the present invention includes a plurality of resistors R1 and R2, as shown in FIG. 5. The resistors R1 and R2 are connected in series between the first voltage line VL1 and the second voltage line VL2. As a result, the voltage supply circuit 59 divides the first voltage VDD1 and second voltage VDD2 through the resistors R1 and R2 and supplies the resulting voltage to the source electrode of the second TFT Tr22 through the second node n2.

Thus, in the light emitting display device according to the fourth embodiment of the present invention, even though the first voltage VDD1 varies, it is possible to minimize a variation in the voltage between the gate electrode and source electrode of the first TFT Tr21.

As apparent from the above description, the present invention provides a light emitting display device in which different voltages are supplied to first and second TFTs interconnected in the form of a current mirror. A voltage supply circuit is provided in the light emitting display device to divide the voltage supplied to the first TFT and supply the resulting voltage to the second TFT. As a result, the voltage supplied to the second TFT varies with the voltage supplied to the first TFT. In conclusion, in the light emitting display device of the present invention, even though the voltage supplied to the first TFT varies, it is possible to maintain a variation difference between voltages supplied to respective pixels constant, because the voltage supplied to the second TFT also varies.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting display device including a display unit having a plurality of pixels defined by and associated with a plurality of gate lines and a plurality of data lines, each of the pixels comprising:

a light emitting element that emits light in response to a drive current based on a gray-scale current on the associated data line;

a first switching element that supplies the drive current to the light emitting element;

a first voltage line that supplies a first voltage to a source electrode of the first switching element;

a second switching element connected with the first switching element that forms a current mirror with the first switching element, wherein a gate electrode of the first switching element is connected with a gate electrode of the second switching element;

a second voltage line that supplies a second voltage to the second switching element, wherein the second voltage is higher than the first voltage; and a voltage supply circuit that divides the first voltage from the first voltage line and the second voltage from the second voltage line, outputs a divided voltage through a second node and supplies the divided voltage to a source electrode of the second switching element;

a third switching element for forming a short circuit between the gate electrode and drain electrode of the second switching element in response to a scan pulse from an associated one of the gate lines;

a fourth switching element for connecting the second switching element with the associated data line in response to the scan pulse from the associated gate line; and a capacitor connected between the gate electrode of the first switching element and the source electrode thereof;

a data driver for sinking a gray-scale current over the data lines;

when the first voltage varies in level, the divided voltage at the second node varies in level;

when the divided voltage at the second node varies in level, a voltage at the gate electrode of the first switching element varies in level;

wherein the voltage supply circuit comprises: two fifth switching elements connected in series between the first voltage line and the second voltage line, each of the two fifth switching elements being turned on in response to the scan pulse from the associated gate line to provide a certain resistance; and wherein the second node is formed between the two fifth switching elements and connected to the source electrode of the second switching element;

wherein a gate electrode of the fourth switching element and gate electrodes of the two fifth switching elements are connected to the associated gate line in common;

wherein the gate electrode of the first switching element is connected to the gate electrode of the second switching element through a first node, the source electrode of the first switching element is connected to the first voltage line, and a drain electrode of the first switching element is connected to a anode electrode of the light emitting element;

wherein the gate electrode of the second switching element is connected to the gate electrode of the first switching element through the first node, the source electrode of the second switching element is connected to the second node, and a drain electrode of the second switching element is connected to a source electrode of the fourth switching element;

wherein the second switching element is operated in a saturation region;

wherein a gate electrode of the third switching element is connected to the associated one of the gate lines, a source electrode of the third switching element is connected to the first node, and drain electrode of the third switching element is connected to the drain electrode of the second switching element;

wherein the gate electrode of the fourth switching element is connected to the associated one of the gate lines, a source electrode of the fourth switching element is connected to the drain electrode of the second switching element, a drain electrode of the fourth switching element is connected to the associated data line;

wherein the first voltage is more variable than the second voltage;

when a scan pulse of low logic is supplied to the associated gate line in a current programming period, the third, fourth and fifth switching elements are turned on;

wherein the turned-on fifth switching elements function as resistors with certain resistances;

wherein the voltage supply circuit divides the first voltage supplied from the first voltage line and the second voltage supplied from the second voltage line in a predetermined ratio using the fifth switching elements, and supplies the resulting voltage to the source electrode of the second switching element through the second node;

wherein the first voltage is directly supplied to the first switching element, and the divided voltage of the first voltage and second voltage is supplied to the second switching element;

when the third, fourth and fifth switching elements are turned on, the data driver sinks gray-scale current corresponding to an image to be currently displayed at the associated pixel from a pixel circuit over the associated data line;

wherein the gray-scale current is sunk to the data driver through a current path consisting of the second node, second switching element, fourth switching element and the associated data line;

when the gray-scale current is sunk, a voltage based on the gray-scale current is applied to the first node;

when the first voltage varies due to resistance and capacitance components of the first voltage line, a voltage at the second node and a voltage at the gate electrode of the first switching element vary;

wherein at the time that the voltage at the second node varies, a voltage of the source electrode of the second switching element varies;

wherein at the time that the voltage of the source electrode of the second switching element varies, a voltage of the gate electrode of the second switching element varies;

wherein the voltage of the gate electrode of the second switching element varies, a voltage of the gate electrode of the first switching element varies, wherein a gray-scale current flowing through the second switching element is fixed in amount, wherein the capacitor stores a voltage difference between the voltage applied to the first node and the first voltage, wherein the first switching element conducts the drive current based on the voltage difference and supplies the drive current to the light emitting element, and wherein the drive current is almost constant in amount even though the first voltage varies in level.

2. The light emitting display device as set forth in claim 1, wherein the first voltage line is connected in common to the first switching element of the respective pixel.

3. The light emitting display device as set forth in claim 1, wherein the second voltage line is connected in common to the voltage supply circuit of the respective pixel.

4. The light emitting display device as set forth in claim 1, further comprising a gate driver for driving the gate lines.

* * * * *